US007974548B2

(12) United States Patent
Mano et al.

(10) Patent No.: US 7,974,548 B2
(45) Date of Patent: Jul. 5, 2011

(54) DEVELOPING DEVICE AND IMAGE FORMING APPARATUS INCLUDING SAME

(75) Inventors: Ryosuke Mano, Kashiba (JP); Koichi Mihara, Fujiidera (JP); Masatoshi Kaneshige, Ikoma (JP); Hiroshi Kubota, Kadoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 402 days.

(21) Appl. No.: 12/185,146

(22) Filed: Aug. 4, 2008

(65) Prior Publication Data

US 2009/0041507 A1 Feb. 12, 2009

(30) Foreign Application Priority Data

Aug. 9, 2007 (JP) ..... 2007-208651

(51) Int. Cl.
*G03G 21/00* (2006.01)

(52) U.S. Cl. ..... 399/99; 399/253; 399/254

(58) Field of Classification Search ..... 399/222, 399/255, 258, 99
See application file for complete search history.

(56) References Cited

U.S. PATENT DOCUMENTS 5,579,094 A * 11/1996 Behe et al. ..... 399/99

FOREIGN PATENT DOCUMENTS

| | | |
|---|---|---|
| JP | 10-063081 | 3/1998 |
| JP | 2000-089550 | 3/2000 |
| JP | 2005-091854 | 4/2005 |

* cited by examiner

*Primary Examiner* — David M Gray
*Assistant Examiner* — Roy Yi
(74) *Attorney, Agent, or Firm* — Renner, Otto, Boisselle & Sklar, LLP

(57) ABSTRACT

A developing device of the present invention has a toner supply opening in a first carrying path and in the upstream of the developer carrying direction of a first carrying screw which is further from a developing roller; and a moquette member having feathers on its surface, and being provided, along the developer carrying direction, on the first carrying path. With this arrangement, it is possible to realize a compact developing device having a simple arrangement in which the supplied toner is speedily mixed with the preexisted developer, and the stable toner which is uniformly dispersed and charged can be speedily supplied for development.

7 Claims, 7 Drawing Sheets

DEVELOPING DEVICE AND IMAGE FORMING APPARATUS INCLUDING SAME

This Nonprovisional application claims priority under U.S.C. §119(a) on Patent Application No. 208651/2007 filed in Japan on Aug. 9, 2007, the entire contents of which are hereby incorporated by reference.

FIELD OF THE INVENTION

The present invention relates to a developing device for use in an image forming apparatus, the developing device using a two component developer including toner and carrier.

BACKGROUND OF THE INVENTION

An image forming apparatus, such as a copying machine, a printer and a facsimile, which employs an electrophotographic printing method has been conventionally known. The image forming apparatus which employs the electrophotographic printing method forms an electrostatic latent image on a surface of an image bearing member having a photoreceptor layer. The image forming apparatus develops this electrostatic latent image into a toner image with use of toner supplied from a developing device, transfers the toner image on a sheet such as a paper, and then fixes the toner image on the sheet.

The developing device using a two component developer (hereinafter referred to simply as a developer, too) including toner and carrier stirs and circulate the developer in the device. Thereby, the toner and the carrier are rubbed together and triboelectrically charged. At a developing stage, the thus triboelectrically charged toner move, by electrostatic suction, to the electrostatic latent image formed on the image bearing member, and forms a toner image.

In recent years, there have been demands for speeding-up of image formation. This necessitates the toner to be precisely and speedily charged to a predetermined electric potential. In order to precisely and speedily charge the toner to a predetermined electric potential, it is necessary to sufficiently rub the toner and the carrier while the developer is stirred and carried.

For that purpose, Patent Document 1 discloses an arrangement in which a developer carrying member having a spiral wing body is provided on a developer carrying path, for circulating and carrying the developer, which is provided in a developer container for containing a two component developer, and a mesh screen member is provided between the wing bodies of the developer carrying member.

According to this arrangement, the developer is not only carried by rotation of the developer carrying member, but also stirred and passed through the mesh screen member several times, thereby appropriately charging the toner electrically by friction between the toner and the carrier. The Patent Document 1 describes that the toner can be given appropriate amount of charging by immediately dispersing the supplied toner in the developer.

[Patent Document 1]

Japanese Unexamined Patent Application Publication Tokukaihei No. 10-63081 (published on Mar. 6, 1998)

However, even the developing device described in the Patent Document 1 is insufficient for an image forming apparatus which is more improved in speed. Thus, this developing device cause an unevenness in toner density and toner electric charges. Therefore, the developing device cannot secure high developing performance in such an image forming apparatus.

That is, in the arrangement of the developing device of the Patent Document 1, the supplied toner is dispersed in the developing device by passing through the screen member together with the preexisted developer in accordance with stirring movement of a developer stirring member. Therefore, the more the screen members are provided, the more screen members the toner passes through. This allows an improvement in dispersing effect. Therefore, this makes it possible for the toner to be uniformly dispersed and speedily charged to a desired electric potential.

However, today in an image forming apparatus, there are strong demands for downsizing in addition to speeding-up. Therefore, there is a limit in improving the dispersing effect by increasing the number of screen member. This necessitates development of a developing device having a simple arrangement in which the unevenness in toner density and toner electric charges is not caused, and the stable toner can be speedily supplied in developing.

SUMMARY OF THE INVENTION

An object of the present invention is to provide a developing device and an image forming apparatus including the same which are not increased in size and have a simple arrangement in which the supplied toner is speedily mixed with the preexisted developer, and the stable toner which is uniformly dispersed and charged can be speedily supplied for development.

In order to attain the above object, a developing device of the present invention includes, a developer container tank containing a developer including toner and carrier and having an opening which faces an image bearing member, in the developer container tank, a developer bearing member rotatably disposed so as to face the opening, a first stirring and carrying member and a second stirring and carrying member disposed in parallel to the developer bearing member and configured to stir and carry the developer respectively in directions opposite to each other, and a partition member disposed between the first stirring and carrying member and the second stirring and carrying member and configured to divide an inside of the developer container tank so as to form a first carrying path in which the developer is carried by the first stirring and carrying member and a second carrying path in which the developer is carried by the second stirring and carrying member, the first stirring and carrying path and the second stirring and carrying path communicating with each other at both ends via communicating paths, the developer being circulated between the first and second carrying paths, wherein a toner supply opening configured to supply the toner to the developer container tank is formed in an upstream of the developer carrying direction of the first stirring and carrying member which is further from the developer bearing member among the first stirring and carrying member and the second stirring and carrying member, and the developing device comprises a moquette member having feathers on a surface, and being provided, along the developer carrying direction, on the first carrying path in which the first stirring and carrying member is disposed.

The moquette is a fabric made of worsted yarn with dense and bristled feathers or a fabric made of synthetic fiber having a similar structure. The moquette member includes a member made of such fabrics and a member made of non-fabric fabric-shaped material with dense bristled feathers.

According to the above arrangement, the toner supplied in the upstream of the developer carrying direction of the first stirring and carrying member is, by the first stirring and carrying member, mixed with the preexisted developer and carried along the first carrying path. The toner with low relative density is hard to mix with the developer and is easy to slide on a surface of the developer. However, by passing through an area of the first carrying path in which the moquette member is disposed, the toner is mixed with the developer in a short time.

More specifically, the toner floating on the surface of the developer is attached to the feathers of the moquette member and momentarily retained when passing through an area of the first carrying path in which the moquette member is disposed, and the thus retained toner is mixed with the developer and returned to the first carrying path when the developer passes through the moquette member by the stirring movement of the first stirring and carrying member. The toner is repeatedly retained and discharged (released) with the developer into the developer by the moquette member until the toner pass through the area in which the moquette member is disposed. As a result, the toner are mixed with the developer in a short time.

The toner supplied when passing through the first carrying path is mixed with the preexisted developer, and arrive at the second carrying path in a sufficiently mixed state. Therefore, the toner is uniformly and stably mixed when supplied for development.

Further, when the toner arrives at the second carrying path, the toner is sufficiently mixed with the developer by passing through the area in which the moquette member is disposed and is charged to a predetermined electric potential in the first carrying path by the stirring movement of the first stirring and carrying member. Therefore, the toner is stably charged when supplied for development.

Furthermore, such an arrangement is so simple that the moquette member is disposed in the first carrying path. Therefore, the developing device of the present invention does not become large and can contribute to miniaturization, in comparison with an arrangement in which a plurality of screen members are disposed around an axis of the stirring and carrying member.

Further, an image forming apparatus including the developing device of the present invention is also included in the scope of the present invention. That is, an image forming apparatus include a developing device in which uniform toner density and stable toner charging are secured. This makes it possible to realize high-speed and high-quality printing.

Additional objects, features, and strengths of the present invention will be made clear by the description below. Further, the advantages of the present invention will be evident from the following explanation in reference to the drawings.

DESCRIPTION OF THE EMBODIMENTS

The following description deals with an embodiment of the present invention with reference to FIGS. 1 through 5. It should be noted that the present invention is not limited to this.

Explained first is an image forming apparatus including a developing device of the present embodiment.

(1. Image Forming Apparatus)

Figure 2:
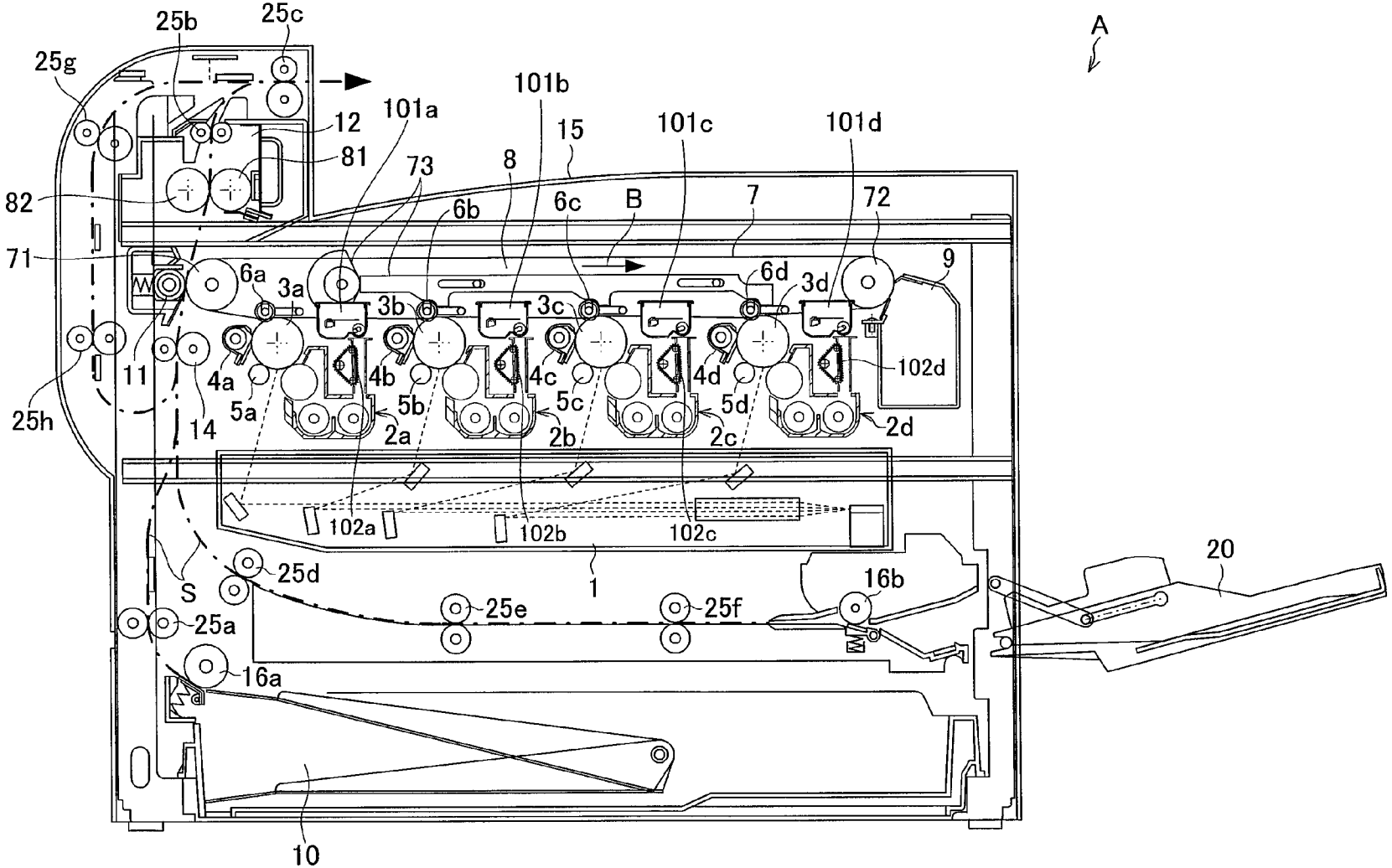
FIG. 2 is a cross-sectional view of an exemplary arrangement of the developing device as seen from a horizontal direction.

FIG. 2 is a diagram explaining an arrangement of an image forming apparatus A of the present embodiment. This image forming apparatus A forms a multicolored or monocolored image on a predetermined sheet (recording medium) in accordance with an image data transmitted from an external device. It should be noted that a device such as a scanner may be mounted above the image forming apparatus A.

As shown in FIG. 2, the image forming apparatus A includes an exposure unit 1, developing devices 2 (2*a*, 2*b*, 2*c*, 2*d*), photoreceptor drums 3 (3*a*, 3*b*, 3*c*, 3*d*), charging devices 5 (5*a*, 5*b*, 5*c*, 5*d*), cleaner units 4 (4*a*, 4*b*, 4*c*, 4*d*), an intermediate transfer belt unit 8, a fixing unit 12, a sheet carrying path S, a paper feeding tray 10, a paper output tray 15 and the like.

The image data of the color image handled in the image forming apparatus A corresponds to the color image using colors of black (K), cyan (C), magenta (M) and yellow (Y). Therefore, the four developing devices 2 (2*a*, 2*b* 2*c*, 2*d*), the four photoreceptor drums 3 (3*a*, 3*b*, 3*c*, 3*d*), the four charging devices 5 (5*a*, 5*b*, 5*c*, 5*d*) and the four cleaner units 4 (4*a*, 4*b*, 4*c*, 4*d*) are provided so as to form four types of toner images corresponding to the respective colors.

The symbols a, b, c and d correspond to black, cyan, magenta and yellow, respectively. Four image stations are constituted by the respective means distinguished by these symbols.

In each of the image stations, the charging device 5 uniformly charges a surface of the photoreceptor drum 3 to a predetermined electric potential. Examples of this charging device 5 include a contact type roller type charging device shown in FIG. 2, contact type brush type charging device and non-contact type charger type charging device.

Examples of the exposure unit 1 include a laser scanning unit (LSU) including a laser irradiation section and a reflection mirror as shown in FIG. 2 and an EL or LED writing head in which light-emitting elements are placed in array. The exposure unit 1 exposes the charged photoreceptor drum 3 in accordance with the inputted image data, and thereby forms an electrostatic latent image according to the image data on the surface of the photoreceptor drum 3.

The electrostatic latent image formed on each of the photoreceptor drums 3 is visualized by the corresponding developing device 2 with use of the toner, K, C, M or Y. Each of the developing devices 2 includes toner hoppers (toner container tank) 101 (101*a*, 101*b*, 101*c*, 101*d*), and toner carrying mechanism 102 (102*a*, 102*b*, 102*c*, 102*d*). The toner hoppers 101 are disposed above the developing devices 2 in a vertical direction and store unused toner (powdery toner). The toner is supplied from the toner hoppers 101 to the developing devices 2 via the toner carrying mechanism 102.

The cleaner units 4 remove and collect the toner remaining on the surface of the photoreceptor drums 3 after the steps of development and image transfer.

The intermediate transfer belt unit 8 is disposed above the photoreceptor drums 3. This intermediate transfer belt unit 8 includes intermediate transfer rollers 6 (6*a*, 6*b*, 6*c*, 6*d*), an intermediate transfer belt 7, an intermediate transfer belt driving roller 71, an intermediate transfer belt follower roller 72, an intermediate transfer belt tension mechanism 73 and an intermediate transfer belt cleaning unit 9.

The intermediate transfer rollers 6, the intermediate transfer belt driving roller 71, the intermediate transfer belt follower roller 72 and the intermediate transfer belt tension mechanism 73 are configured to hold the intermediate transfer belt 7 in a tensioned state and to rotate the intermediate transfer belt 7 in a direction designated by the arrow B.

The intermediate transfer rollers 6 are supported, so as to be able to rotate, at an intermediate transfer roller mounting section in the intermediate transfer belt tension mechanism 73 of the intermediate transfer belt unit 8. The intermediate transfer rollers 6 give transfer bias to transfer a toner image on the photoreceptor drums 3 from the photoreceptor drums 3 onto the intermediate transfer belt 7.

The intermediate transfer belt 7 is provided so as to be in contact with each of the photoreceptor drums 3. The toner images of respective colors which are formed on the photoreceptor drums 3 are superimposed on each other and transferred on the intermediate transfer belt 7. Thus the colored toner image (multicolored toner image) is formed. This intermediate transfer belt 7 is formed endlessly from a film whose thickness is, for example, in the order of 100 μm to 150 μm.

The toner image is transferred from the photoreceptor drums 3 to the intermediate transfer belt 7 by the intermediate transfer rollers 6 that are in contact with the reverse side of the intermediate transfer belt 7. A high voltage transfer bias (a high voltage (+) that has reverse polarity to the charge polarity (−) of the toner) is applied to the intermediate transfer rollers 6 to achieve transfer of the toner image.

Each of the intermediate transfer rollers 6 is formed on the basis of metal (such as stainless steel) axis whose diameter is, for example, 8-10 mm, and its surface is covered with a electrically conductive elastic material (such as EPDM and foam polyurethane). Because of this electrically conductive elastic material, the intermediate transfer rollers 6 can uniformly apply the high voltage to the intermediate transfer belt 7. Explained in the present embodiment is exemplary case in which roller type transfer electrodes (intermediate transfer rollers 6) are used. It should be noted that brush type transfer electrodes may be used instead of the roller type transfer electrodes.

As described above, the electrostatic latent image on each of the photoreceptor drums 3 is visualized by the toner of respective colors and then become the toner images. These toner images are superimposed and stacked on the intermediate transfer belt 7. Thus, the stacked toner images are moved, by rotation of the intermediate transfer belt 7, to the area in which a carried paper comes in contact with the intermediate transfer belt 7, and then the toner images are transferred on the paper by a transfer roller 11 disposed at this position. In this case, the intermediate transfer belt 7 and the transfer roller 11 are pressured so as to form a predetermined nip, and the voltage is applied to the transfer roller 11 to transfer the toner images on the paper. This voltage is a high voltage (+) that has reverse polarity to the charge polarity (−) of the toner.

For the purpose of constantly obtaining the nip, one of the transfer roller 11 and the intermediate transfer belt driving roller 71 is made of a solid material such as metal and the other is made of a soft material such as an elastic roller (e.g. elastic rubber roller and foam resin roller).

Among the toner adheres to the intermediate transfer belt 7 due to the contact between the intermediate transfer belt 7 and the photoreceptor drums 3, some toner remains on the intermediate transfer belt 7 without being transferred when the toner images are transferred from the intermediate transfer belt 7 on the paper. Such remained toner causes a problem that colors of the toner are undesirably mixed in the next imaging process. Therefore, such toner is removed and collected by the intermediate transfer belt cleaning unit 9. The intermediate transfer belt cleaning unit 9 includes, for example, a cleaning blade as a cleaning member that is in contact with the intermediate transfer belt 7. The part of the intermediate transfer belt 7 which is contact with this cleaning blade is supported from the reverse side by the intermediate transfer belt follower roller 72.

The paper feeding tray 10 for storing a sheet, such as a recording paper, used for image forming is provided below an image forming section and the exposure unit 1. The paper output tray 15 for laying the printed sheet facedown is provided in an upper portion of the image forming apparatus A.

Further, the image forming apparatus A includes the sheet carrying path S for carrying sheets in the paper feeding tray 10 and sheets in a manual paper feeding tray 20 to the paper output tray 15 via a transfer section (section opposite to the photoreceptor drums 3 and the transfer roller 11) or via the fixing unit 12. Disposed between the paper feeding tray 10 and the paper output tray 15 along the sheet carrying path S are the transfer section including pickup rollers 16 (16*a*, 16*b*), a resist roller 14 and the transfer roller 11; the fixing unit 12; carrying rollers 25 (25*a* through 25*h*) and the like.

A plurality of carrying rollers 25 that are small rollers for facilitating and assisting the conveyance of the sheets are provided along the sheet carrying path S. The pickup rollers 16 provided at an end of the paper feeding tray 10 are rollers for supplying sheets one by one from the paper feeding tray 10 to the sheet carrying path S. The resist roller 14 momentarily keeps the sheets which is carried along the sheet carrying path S, and carries the sheets to the transfer section when an edge of the toner image on the intermediate transfer belt 7 matches with an edge of the sheet.

The fixing unit 12 includes a heat roller 81, a pressure roller 82 and the like. The heat roller 81 and the pressure roller 82, which sandwich the sheet, rotate. The heat roller 81 is controlled by a control section (not shown) so as to have a predetermined fixing temperature. This control section controls the heat roller 81 on the basis of a detection signal from a heat detection device (not shown). The heat roller 81 and the pressure roller 82 press the sheet while applying heat on the sheet. Thereby, the heat roller 81 and the pressure roller 82 fuse, mix and press the toner image of respective colors which is transferred on the sheet, thereby thermally fixing the toner image on the sheet. It should be noted that the sheet on which the multicolored toner image (toner image of respective color) is fixed is carried, by the plurality of carrying rollers 25, to a reversal paper output path of the sheet carrying path S, and is outputted on the paper output tray 15 in a reversal state (state in which the multicolored toner image faces downward).

Explained next is a sheet carrying operation of the sheet carrying path S. As described above, the image forming apparatus A includes the paper feeding tray 10 containing the sheet in advance and the manual paper feeding tray 20 used in such a case in which a small number of papers are printed. The pickup rollers 16 (16*a*, 16*b*) are disposed at the paper feeding tray 10 and the manual paper feeding tray 20, respectively. These pickup rollers 16 supply the sheets one by one to the sheet carrying path S.

In a case of one-sided printing, the sheet carried from the paper feeding tray 10 is carried to the resist roller 14 by the carrying rollers 25 disposed along the sheet carrying path S, and then is carried, by this resist roller 14, to the transfer section at such timing that an edge of the sheet matches with an edge of the toner image stacked on the intermediate transfer belt 7. By the transfer section, the toner image is transferred on the sheet and, by the fixing unit 12, the toner image is fixed on the sheet. Then, the sheet is outputted onto the paper output tray 15 from the paper output roller 25*c* via the carrying roller 25*b*.

The sheet carried from the manual paper feeding tray 20 is carried to the resist roller 14 by the plurality of carrying rollers 25 (25*f*, 25*e*, 25*d*). After that, the sheet supplied from the manual paper feeding tray 20 follows a similar process as the sheet supplied from the paper feeding tray 10, and then outputted onto the paper output tray 15.

In a case of double-sided printing, after the one-sided printing is completed, the sheet that passed through the fixing unit 12 is held at its rear end by the paper output roller 25*c*. Next, the sheet is led to the carrying rollers 25*g* and 25*h* by reverse rotation of the paper output roller 25*c*, and carried to the resist roller 14. After the reverse side is printed, the sheet is outputted to the paper output tray 15.

(2. Arrangement of the Developing Device)

Figure 1:
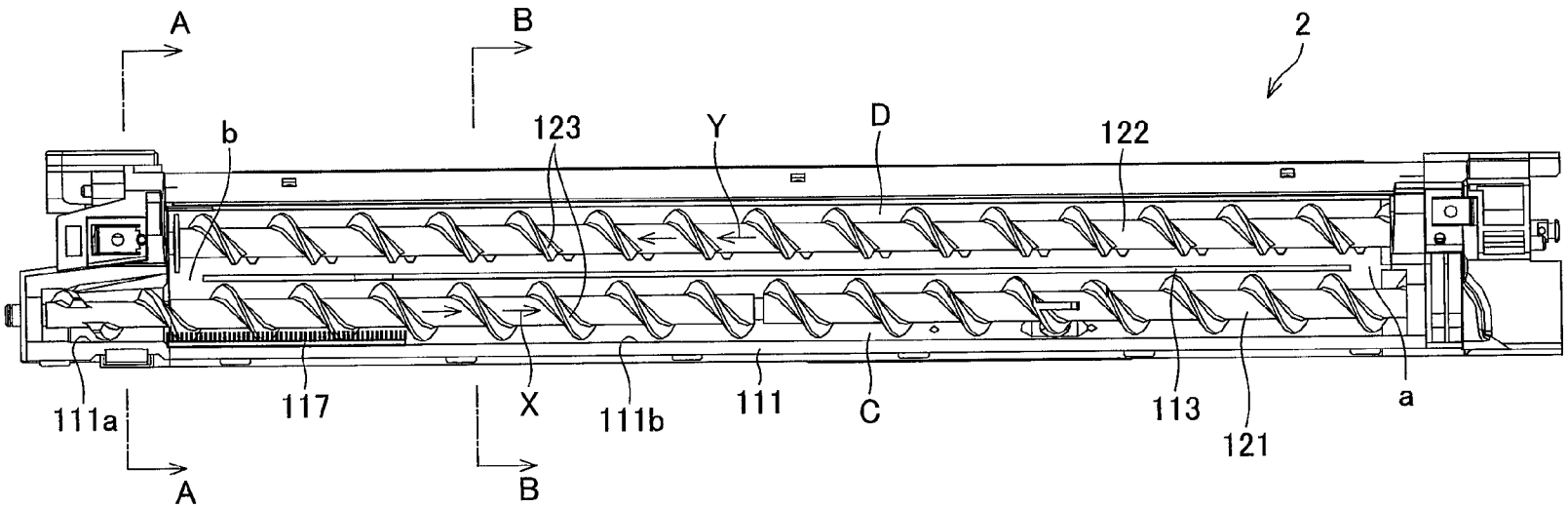
FIG. 1 is a schematic cross-sectional view of an image forming apparatus including a developing device of the present invention.
Figure 3:
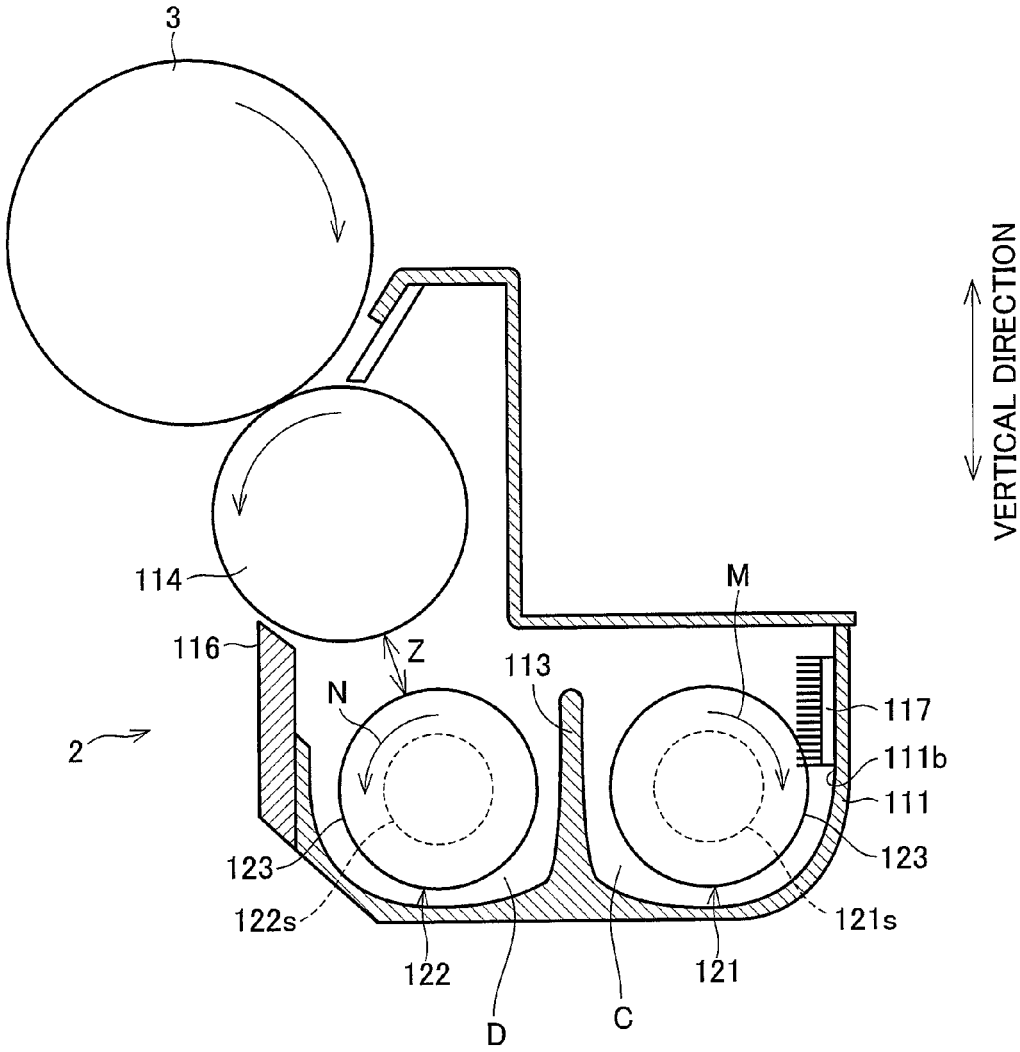
FIG. 3 is a top view of the developing device from which a developing roller is removed.
Figure 4:
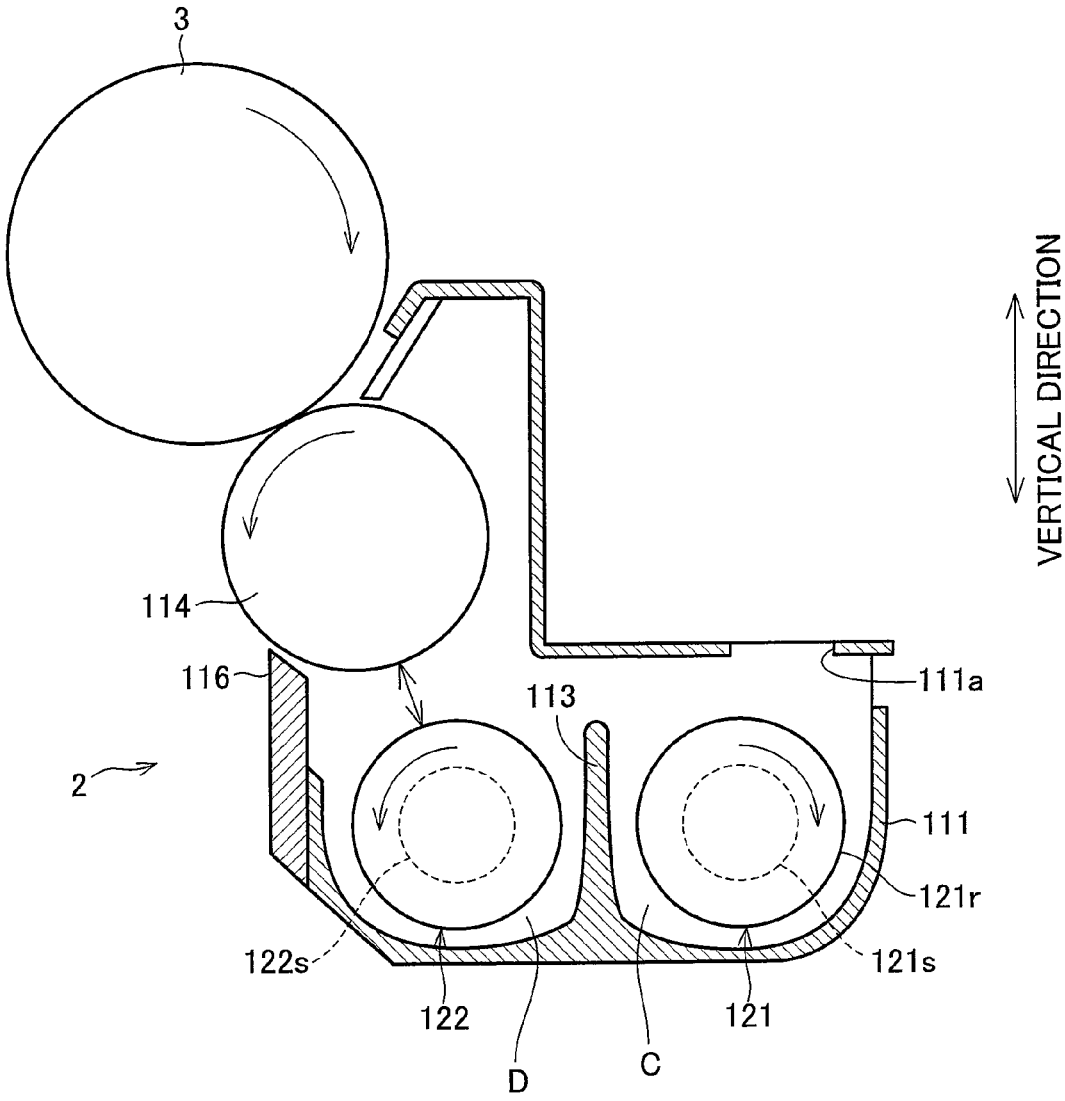
FIG. 4 is a perspective view of an exemplary arrangement of a moquette member included in the developing device.
Figure 5:
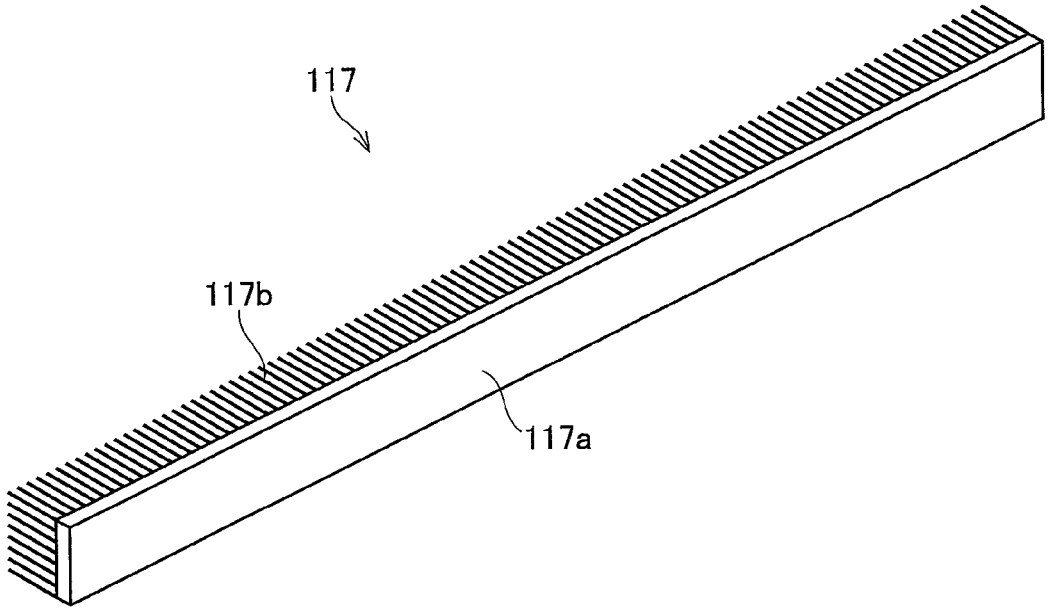
FIG. 5 is a cross-sectional view of the vicinity of a toner supply opening of the developing device as seen from a horizontal direction.

The following is a detailed explanation of the developing devices (2*a*, 2*b*, 2*c*, 2*d*) included in the image forming apparatus A. FIG. 1 is a plan view of the developing device 2 as seen from a top in a vertical direction, and is a plan view showing the inside of a developer container tank 111 from which a developing roller 114 is removed. FIGS. 3 and 4 are cross-sectional views of the developing device 2 as seen from a horizontal direction, FIG. 3 is a cross-sectional view taken at a middle section in a longitudinal direction (taken from B-B' line shown in FIG. 1), and FIG. 4 is a cross-sectional view taken at an end section of a longitudinal direction in which a toner supply opening 111*a* is formed (taken from A-A' line shown in FIG. 1). The toner supply opening 111*a* will be described below. FIG. 5 is a perspective view of a moquette member which will be described later.

As shown in FIG. 3, the developing device 2 includes the developing roller 114 which is disposed so as to face the photoreceptor drum 3. The electrostatic latent image formed on the surface of the photoreceptor drum 3 is visualized by the developing device 2 which supplies the toner to the surface of the photoreceptor drum 3 with use of the developing roller 114.

The developing device 2 includes, in addition to the developing roller 114, the developer container tank 111, a doctor blade 116, a first carrying screw 121, a second carrying screw 122, a partition board (partition member) 113 and a moquette member 117.

The developer container tank 111 is a tank for containing a two component developer including toner and carrier. The developing roller 114, the first carrying screw 121, the second carrying screw 122 and the like are disposed in the developer container tank 111.

The developing roller 114 which is disposed near and faces to the photoreceptor drum 3 is a magnet roller, and is set so as to be rotated in a direction same as a rotating direction of the photoreceptor drum 3. The developing roller 114 supplies the toner in the developer container tank 111 to the photoreceptor drum 3. The blade (doctor blade) 116 for regulating the thickness of a toner layer is disposed in the vicinity of the outer circumference of the developing roller 114.

The first carrying screw 121 and the second carrying screw 122 are screw type rollers (stirring roller) for stirring and carrying the developer. As shown in FIG. 1, the first carrying screw 121 and the second carrying screw 122 have, along their shaft, a stirring blade 123 for stirring and carrying the developer. When the shaft is rotated by driving means (not shown) such as a motor, the first carrying screw 121 and the second carrying screw 122 stir and carry the developer.

As shown in FIG. 3, the first carrying screw 121 and the second carrying screw 122 are arranged in parallel so that their outer surfaces face with each other via the partition board 113 and are set so as to rotate in the direction opposite to each other. More specifically, the first carrying screw 121 carries the developer in a direction designated by the arrow X shown in FIG. 1, and the second carrying screw 122 carries the developer in a direction designated by the arrow Y that is opposite to a direction designated by the arrow X.

It should be noted that the distance shown by the double arrow Z between the second carrying screw 122 and the developing roller 114 is in a range of 3 to 7 mm.

The partition board 113 disposed between the first carrying screw 121 and the second carrying screw 122 stretches in a direction parallel to rotary shafts of these screws 121 and 122. This partition board 113 partitions the inside of the developing container tank 111 into a first carrying path C in which the first carrying screw 121 is disposed, and a second carrying path D in which the second carrying screw 122 is disposed.

The second carrying path D is in the vicinity of the developing device 114. Therefore, the second carrying path D is narrower than the first carrying path C, and the level of the developer in the second carrying path D is higher than that of the first carrying path C.

Further, the partition board 113 is disposed so as to be separated from a side wall 111*b* of the developing container tank 111 at both ends of the rotary shaft direction of the first carrying screw 121 and the second carrying screw 122. Thus, a communicating path for connecting the first carrying path C and the second carrying path D is formed in the vicinity of the both ends of the rotary shaft direction of the first carrying screw 121 and the second carrying screw 122.

Hereinafter, a communicating path formed at the downstream of the developer carrying direction of the first carrying screw 121 is referred to as a first communicating path a, and a communicating path formed at the upstream of the developer carrying direction of the first carrying screw 121 is referred to as a second communicating path b.

Further, as shown in FIG. 1 and FIG. 4 which is cross-sectional view of FIG. 1 taken from A-A' line, in the developer container tank 111, the toner supply opening 111*a* for supplying unused toner into the developer container tank 111 is formed at the upstream of the developer carrying direction of the first carrying path C (i.e. upstream of the developer carrying direction of the first carrying screw 121).

As shown in FIGS. 1 and 3, in the developing device 2 of the present embodiment, the long moquette member 117 having feathers on its surface is provided in the first carrying path C along the developer carrying direction. In the first carrying path C of the developer container tank 111, the toner supply opening 111*a* is provided at the upstream of the developer carrying direction. The moquette member 117 includes a moquette that is a fabric made of worsted yarn with dense and bristled "feathers" or a fabric made of synthetic fiber having a similar structure. The moquette member 117 is a member made of such moquette.

The moquette member 117 is a member by which the toner newly supplied from the toner supply opening 111*a* is speedily mixed with the preexisted toner. This moquette member 117 will be described below in detail.

FIG. 5 is a perspective view of the moquette member 117. The moquette member 117 of the present embodiment is constituted by a moquette section 117*b* and a base member 117*a* to which the moquette section 117*b* is fixed. For example, the moquette member 117 has total length of 90 mm in longitudinal direction, feather length of 8 mm, width of 10 mm and 35000 feathers per sq inch. It should be noted that these values of the moquette member 117 are examples and the present invention is not limited to this.

As shown in FIGS. 1 and 3, such a moquette member 117 is fixed to the side wall 111*b* extending to the longitudinal direction of the developer container tank 111, and defining the first carrying path C.

(3. Stirring and Mixing of the Developer)

The following is detailed explanation of stirring and mixing of the developer in the developing devices 2 (2*a*, 2*b*, 2*c*, 2*d*).

In the developer container tank 111 of the developing device 2, the first carrying screw 121 and the second carrying screw 122 are rotated by the driving means (not shown) and carry and circulate the developer in the direction designated by the arrows M and N shown in FIG. 3. Specifically, in the first carrying path C, the developer is carried and stirred, by the first carrying screw 121, from the upstream side to the downstream side of the direction designated by the arrow X of FIG. 1. The developer carried to the downstream of the first carrying path C is carried to the second carrying path D via the first communicating path a. Further, in the second carrying path D, the developer is carried and stirred, by the first carrying screw 121, from the upstream side to the downstream side of the direction designated by the arrow Y shown in FIG. 1. That is, the first carrying screw 121 and the second carrying screw 122 stir and carry the developer in the direction opposite to each other.

Thus, in the developer container tank 111, the developer is stirred while circulating through the first carrying path C and the second carrying path D.

While the developer which circulates through the first carrying path C and the second carrying path D is being carried in the second carrying path D, the developer is held on the surface of the developing roller 114, and taken up by rotation of the developing roller 114. Only the toner in the taken-up developer is moved to the photoreceptor drum 3 and is consumed.

The unused toner is supplied from the toner supply opening 111*a* in the upstream of the developer carrying direction of the first carrying screw 121 in order to make up for the thus consumed toner. The supplied toner is mixed and stirred with the preexisted developer along the first carrying path C by the rotation of the first carrying screw 121.

Just by stirring and carrying of the first carrying screw 121, the supplied toner is hardly mixed with the preexisted developer due to its low density. The supplied toner will slide on the surface of the preexisted developer without being mixed with the developer.

As shown in FIG. 3, in the developing device 2 of the present invention, the moquette member 117 is disposed in the first carrying path C. Therefore the supplied toner is mixed, in a short time, with the developer sinking in the lower part when passing through the area in which the moquette member 117 is disposed.

The following explains how the toner is sent into the developer with reference to FIG. 3. The first carrying screw 121 has the spiral stirring blade 123 to send the toner and the developer to the depth direction of the paper where FIG. 3 is drawn and the first carrying screw 121 carries the developer by rotating in a clockwise direction designated by the arrow M.

The toner sent to the area where the moquette member 117 is provided is pushed into the moquette member 117 (into the feathers) by the rotation of the first carrying screw 121. At the same time, the toner and the developer which was pushed into the moquette member 117 is pushed out and pushed (released) into the developer in the developer container tank 111.

The spiral stirring blade 123 of the first carrying screw 121 has a spiral shape. Therefore, by transmitting the movement of the spiral stirring blade 123 in the depth direction of the paper where FIG. 3 is drawn, the toner is repeatedly taken in the moquette member 117 and discharged (released) with the developer in the area where the moquette member 117 is provided. Thus, the supplied toner is mixed, in a short time, with the developer preexisted in the developer container tank 111.

The toner thus sufficiently mixed with the developer while passing through the area where the moquette member 117 is disposed arrives at the second carrying path D in a state where the toner is charged to a predetermined electric potential by the stirring movement of the first carrying screw 121 while passing through the first carrying path C.

As a result, the toner is stably charged to a predetermined electric potential and uniformly and stably dispersed when supplied for development in the second carrying path D. This makes it possible to realize high-quality and high-speed development.

Furthermore, such an arrangement is so simple that the moquette member 117 is disposed in the first carrying path C. Therefore, the device does not become large and can contribute to miniaturization, in comparison with an arrangement in which a plurality of screen members are disposed around an axis of the stirring and carrying member.

Further, in the present invention, the moquette member 117 is provided so that the lower part of the feather tip is in contact with the stirring blade 123 of the first carrying screw 121. Therefore, the stirring blade 123 rubs the feather tip due to the periodic rotation of the first stirring and carrying member. This makes it possible to effectively send the toner retained in the moquette member 117 in the developer.

Further, in the present embodiment, the moquette member 117 is positioned in the vicinity of and downstream of the toner supply opening 111*a* in the developer carrying direction. This makes it possible to immediately start the mixing of the supplied toner and the developer and thereby making it possible to mix the supplied toner with the developer in a shorter time.

It should be noted that the moquette member 117 may be provided in the area of the toner supply opening 111*a*. However, it is necessary to secure a large space in the toner supply opening 111*a* to supply the toner from the upper part. Therefore, it is preferable that the moquette member 117 is disposed in the downstream of the developer carrying direction rather than in the toner supply opening 111*a*.

Further, in the present embodiment, the moquette member 117 is disposed on the side wall 111*b* extending to the longitudinal direction of the developer container tank 111 and defining the first carrying path C. It should be noted that the moquette member may be provided on the wall surface of the partition board 113. When the moquette member 117 is provided on the side surface extending along the developer carrying direction of the first carrying path C, the toner sliding on the surface of the developer can be effectively captured in the moquette member and be mixed with the developer.

Further, in that case, it is more preferable that the moquette member 117 is provided at the side in which the developer is stirred from up to down in consideration of the stirring and carrying direction of the first carrying screw 121. This is because the toner floating on the surface of the developer tends to gather on the side wall in which the developer is stirred from up to down by the stirring movement of the first carrying screw 121.

Therefore, in the present embodiment, the moquette member is provided on the side wall 111*b* in the vicinity of which the developer is stirred from up to down by the first carrying screw 121. This makes it possible to mix the toner with the developer more effectively in comparison with a case in which the moquette member is provided on the wall surface of the partition board 113 in which the developer is stirred from down to up.

Figure 6:
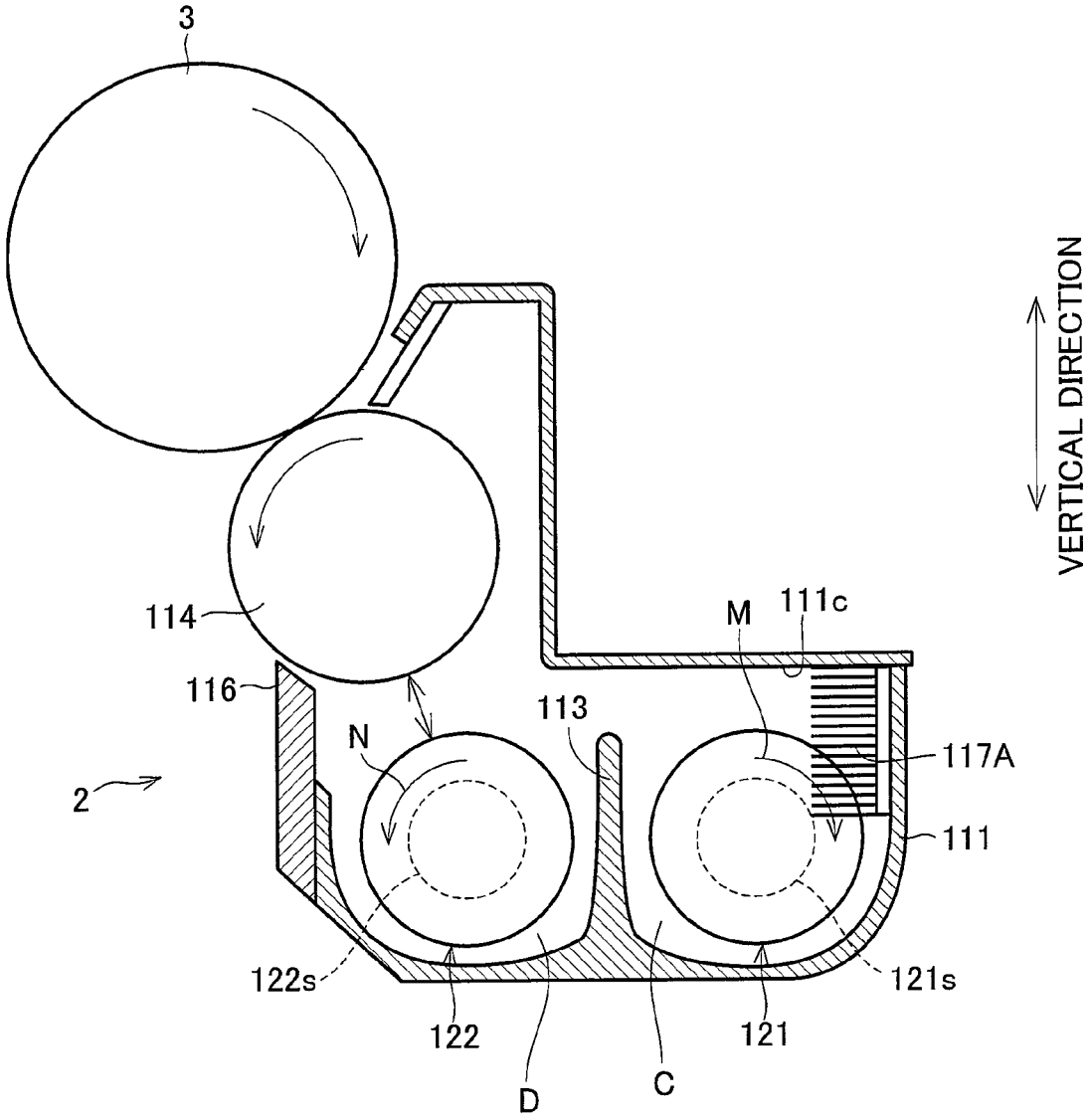
FIG. 6 is a cross-sectional view of another exemplary arrangement of the developing device as seen from horizontal direction.
Figure 7:
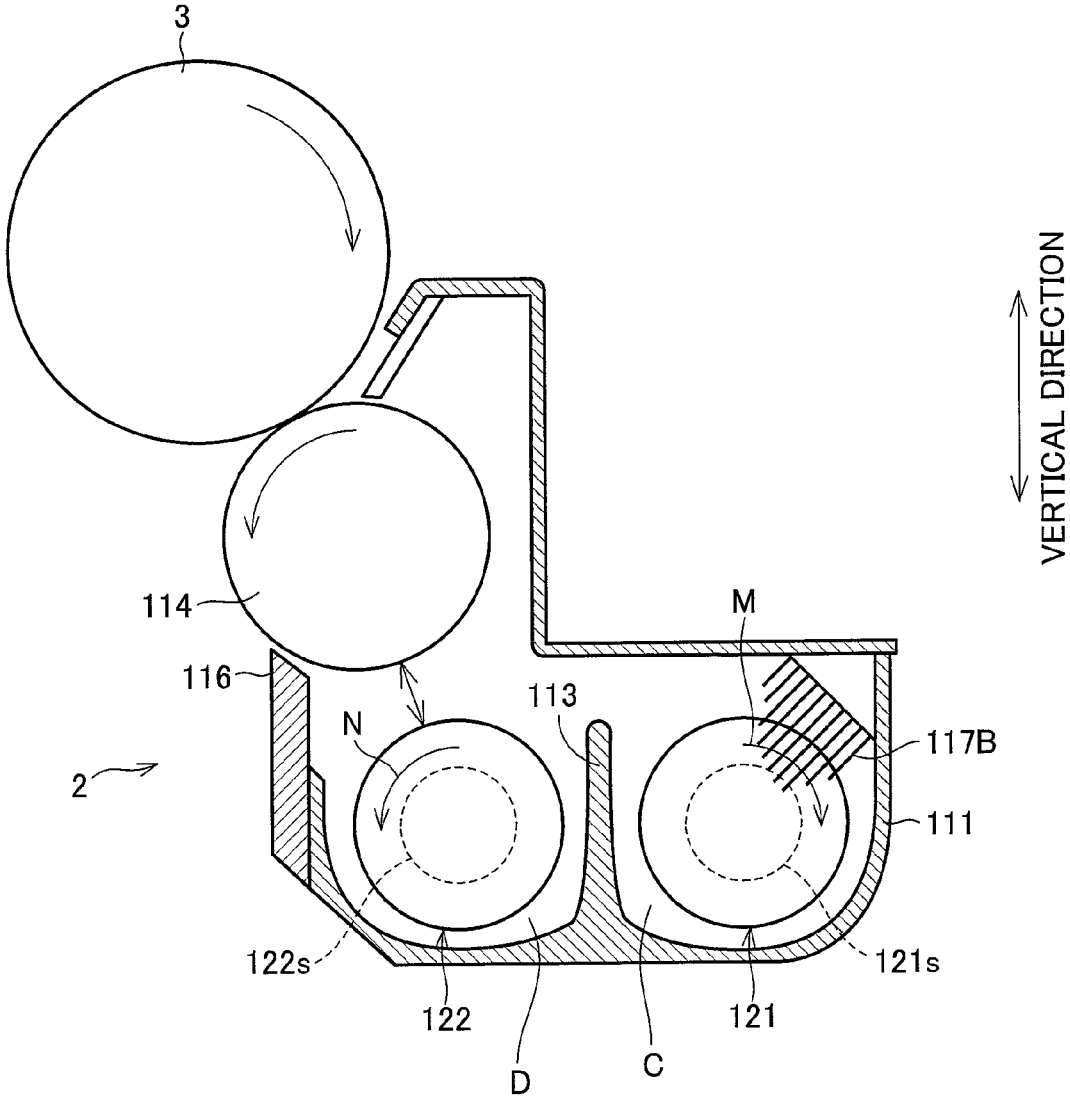
FIG. 7 is a cross-sectional view of still another exemplary arrangement of the developing device as seen from a horizontal direction.

FIGS. 6 and 7 are other example of the moquette member 117 included in the developing device 2. A moquette member 117A is configured to reach a ceiling surface 111*c* of the developer container tank 111. According to this arrangement, it is possible to capture the toner sliding on the surface of the developer in the moquette member 117A. Therefore, it is possible to more surely send the toner in the developer in comparison with the moquette member 117 of FIG. 3 which does not reach the ceiling surface 111*c*.

Furthermore, the moquette member 117A shown in FIG. 6 is provided so as to be in contact with the rotary shaft of the first carrying screw 121. Therefore, the moquette member 117A can give the feather tip a stronger shake than the moquette member whose feather tip is in contact with the stirring blade and can send the toner in the developer more effectively.

Further, a moquette member 117B shown in FIG. 7 is arranged so that its feather tip faces the rotary shaft of the first carrying screw 121. According to this arrangement, the moquette member 117B is positioned vertically to the rotary shaft of the first carrying screw 121. Therefore, the first carrying screw 121 can apply a strong rotary force to the moquette member from the side. This makes it possible to retain and release the toner most smoothly, and thereby making it possible to more speedily mix the toner with the developer.

Furthermore, in an arrangement shown in FIG. 7, the moquette member 117B is provided so as to cover the rotary shaft of the first carrying screw 121 from diagonal direction of the side in which the developer is stirred from up to down. This makes it possible to surely retain, in the moquette member 117B, the toner which tends to aggregate at the surface of the developer and at the side of the side wall 111*b* due to the rotation of the first carrying screw 121.

In the above explanation, the length of the moquette member 117 in the developer carrying direction, the length of the feather and the density of the feather of the moquette member 117 are given only one example and are not specifically referred. It is only necessary to mix the toner with the developer while the toner passes through the area where the moquette member 117 is disposed. Therefore, it is only necessary to design the moquette member 117 in consideration of the maximum amount of toner supply and the like.

Further, materials used for the moquette section 117*b* and the base member 117*a* in the moquette member 117 are selected in accordance with the charging property of the toner, strength and rigidity. For example, fiber made of a material such as nylon and polyester can be used for the moquette section 117*b*. Further, sheet made of a material such as nylon and polyester can be used for the base member 117*a*. The moquette section 117*b* is weaved into the sheet so as not to come out.

As described above, a developing device of the present invention includes, a developer container tank containing a developer including toner and carrier and having an opening which faces an image bearing member, in the developer container tank, a developer bearing member rotatably disposed so as to face the opening, a first stirring and carrying member and a second stirring and carrying member disposed in parallel to the developer bearing member and configured to stir and carry the developer respectively in directions opposite to each other, and a partition member disposed between the first stirring and carrying member and the second stirring and carrying member and configured to divide an inside of the developer container tank so as to form a first carrying path in which the developer is carried by the first stirring and carrying member and a second carrying path in which the developer is carried by the second stirring and carrying member, the first stirring and carrying path and the second stirring and carrying path communicating with each other at both ends via communicating paths, the developer being circulated between the first and second carrying paths, wherein a toner supply opening configured to supply the toner to the developer container tank is formed in an upstream of the developer carrying direction of the first stirring and carrying member which is further from the developer bearing member among the first stirring and carrying member and the second stirring and carrying member, and the developing device comprises a moquette member having feathers on a surface, and being provided, along the developer carrying direction, on the first carrying path in which the first stirring and carrying member is disposed.

With this arrangement, it is possible to realize a compact developing device having a simple arrangement in which the supplied toner is speedily mixed with the preexisted developer, and the stable toner which is uniformly dispersed and charged can be speedily supplied for development.

In the developing device of the present invention, it is preferable that the moquette member is positioned in the vicinity of and downstream of the toner supply opening in the developer carrying direction.

This makes it possible to immediately start mixing of the supplied toner and the developer, and thereby making it possible to mix the supplied toner with the developer in a short time.

Further, in the developing device of the present invention, the moquette member may be disposed on a side wall extending to a longitudinal direction of the developer container tank or a wall surface of the partition member, the side wall and the wall surface defining the first carrying path.

With this arrangement, the toner sliding on the surface of the developer can be effectively captured in the moquette member and be mixed with the developer.

Further, in the developing device of the present invention, it is preferable that the moquette member is provided on that one of the side wall and the wall surface of the partition member in the vicinity of which the developer is stirred from up to down by the first stirring and carrying screw.

The toner floating on the preexisted developer tends to gather at the wall surface in the vicinity of which the developer is stirred from up to down due to the stirring movement of the first stirring and carrying screw. Therefore, when the moquette member is provided on the wall surface in the vicinity of which the developer is stirred from up to down, the toner can be mixed with the developer more effectively, as compared with the case where the moquette member is provided on the wall surface in the vicinity of which the developer is stirred from down to up.

Further, in the developing device of the present invention, it is preferable that the moquette member is configured to reach the ceiling surface of the developer container tank.

This makes it possible to surely capture the toner sliding on the surface of the developer in the moquette member, and thereby making it possible to send the toner in the developer more surely, as compared with the arrangement where the moquette member does not reach the ceiling surface.

Further, in the developing device of the present invention, the moquette member can be provided so that its feather tip is in contact with the stirring blade of the first stirring and carrying member.

According to this arrangement, the feather tip of the moquette member is in contact with the stirring blade of the first stirring and carrying member. Therefore, the stirring blade rubs the feather tip due to the periodic rotation of the first stirring and carrying member. This makes it possible to effectively send the toner retained in the moquette member in the developer.

Further, in the developing device of the present invention, the moquette member can be provided so that its feather tip is in contact with the rotary shaft of the first stirring and carrying member.

According to this arrangement, the feather tip of the moquette member is in contact with the rotary shaft of the first stirring and carrying member. This makes it possible to give the feather tip a stronger shake, and thereby making it possible to more effectively send the toner in the developer.

Further, in the developing device of the present invention, the moquette member can be provided so that its feather tip faces the rotary shaft of the first stirring and carrying member.

According to this arrangement, the moquette member is positioned vertically to the rotary shaft. This makes it possible to apply a strong rotary force of the first stirring and carrying member from the side. The toner can be retained and released most smoothly and mixed with the developer more speedily.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

Further, it is needless to say that numerical value may be different from the value shown in the present specification and any practical value which does not contradict with the intention of the present invention falls within the scope of the present invention.

What is claimed is:

1. A developing device, comprising:

a developer container tank containing a developer including toner and carrier and having an opening which faces an image bearing member, in the developer container tank, a developer bearing member rotatably disposed so as to face the opening, a first stirring and carrying member and a second stirring and carrying member disposed in parallel to the developer bearing member and configured to stir and carry the developer respectively in directions opposite to each other, and a partition member disposed between the first stirring and carrying member and the second stirring and carrying member and configured to divide an inside of the developer container tank so as to form a first carrying path in which the developer is carried by the first stirring and carrying member and a second carrying path in which the developer is carried by the second stirring and carrying member, the first stirring and carrying path and the second stirring and carrying path communicating with each other at both ends via communicating paths, the developer being circulated between the first and second carrying paths, wherein a toner supply opening configured to supply the toner to the developer container tank is formed in an upstream of the developer carrying direction of the first stirring and carrying member which is further from the developer bearing member among the first stirring and carrying member and the second stirring and carrying member, the developing device comprises a moquette member, and being provided, along the developer carrying direction, on the first carrying path in which the first stirring and carrying member is disposed, the first stirring and carrying member has a rotary shaft extending along a horizontal direction and a spiral stirring blade provided on an outer surface of the rotary shaft and stirs and carries the developer by being driven to rotate on the rotary shaft, and the moquette member has its feather tip in contact with the rotary shaft of the first stirring and carrying member.

2. The developing device according to claim 1, wherein:

the moquette member is positioned in the vicinity of and downstream of the toner supply opening in the developer carrying direction.

3. The developing device according to claim 1, wherein:

the moquette member is disposed on a side wall extending to a longitudinal direction of the developer container tank or a wall surface of the partition member, the side wall and the wall surface defining the first carrying path.

4. The developing device according to claim 3, wherein:

the moquette member is provided on that one of the side wall and the wall surface of the partition member in the vicinity of which the developer is stirred from up to down by the first stirring and carrying screw.

5. The developing device according to claim 1, wherein:

the moquette member is configured to reach a ceiling surface of the developer container tank.

6. The developing device according to claim 1, wherein:

the moquette member is provided so that its feather tip faces the rotary shaft of the first stirring and carrying member.

7. An image forming apparatus comprising:

a developing device, wherein the developing device includes:

a developer container tank containing a developer including toner and carrier and having an opening which faces an image bearing member, in the developer container tank, a developer bearing member rotatably disposed so as to face the opening, a first stirring and carrying member and a second stirring and carrying member disposed in parallel to the developer bearing member and configured to stir and carry the developer respectively in directions opposite to each other, and a partition member disposed between the first stirring and carrying member and the second stirring and carrying member and configured to divide an inside of the developer container tank so as to form a first carrying path in which the developer is carried by the first stirring and carrying member and a second carrying path in which the developer is carried by the second stirring and carrying member, the first stirring and carrying path and the second stirring and carrying path communicating with each other at both ends via communicating paths, the developer being circulated between the first and second carrying paths, wherein a toner supply opening configured to supply the toner to the developer container tank is formed in an upstream of the developer carrying direction of the first stirring and carrying member which is further from the developer bearing member among the first stirring and carrying member and the second stirring and carrying member, the developing device comprises a moquette member, and being provided, along the developer carrying direction, on the first carrying path in which the first stirring and carrying member is disposed, the first stirring and carrying member has a rotary shaft extending along a horizontal direction and a spiral stirring blade provided on an outer surface of the rotary shaft and stirs and carries the developer by being driven to rotate on the rotary shaft, and the moquette member has its feather tip in contact with the rotary shaft of the first stirring and carrying member.

* * * * *